US008727260B2

(12) United States Patent
Oravits et al.

(10) Patent No.: US 8,727,260 B2
(45) Date of Patent: May 20, 2014

(54) WINDER ASSEMBLY AND METHOD OF USE THEREOF

(75) Inventors: Thomas J. Oravits, Durham, CT (US); John Radovich, Mystic, CT (US); Edward J. Smith, Frenchtown, NJ (US)

(73) Assignee: Davis-Standard, LLC, Pawcatuck, CT (US)

( * ) Notice: Subject to any disclaimer, the term of this patent is extended or adjusted under 35 U.S.C. 154(b) by 188 days.

(21) Appl. No.: 13/371,768

(22) Filed: Feb. 13, 2012

(65) Prior Publication Data

US 2013/0205962 A1 Aug. 15, 2013

(51) Int. Cl.
*B65H 19/22* (2006.01)

(52) U.S. Cl.
USPC ..... 242/533.4; 242/533.5; 242/527.2

(58) Field of Classification Search
USPC ..... 242/526, 527.2–527.3, 533.4–533.5
See application file for complete search history.

(56) References Cited

U.S. PATENT DOCUMENTS

| | | | | | |
|---|---|---|---|---|---|
| 3,377,032 | A * | 4/1968 | Jacobs et al. | ..... | 242/527.3 |
| 3,478,975 | A * | 11/1969 | Penrod | ..... | 242/532 |
| 3,871,595 | A * | 3/1975 | Smolderen | ..... | 242/527.4 |
| 4,326,679 | A * | 4/1982 | Phelps et al. | ..... | 242/526 |
| 4,484,714 | A * | 11/1984 | Puzey | ..... | 242/527.3 |
| 5,417,382 | A * | 5/1995 | Petitjean et al. | ..... | 242/527 |
| 5,845,867 | A * | 12/1998 | Hould et al. | ..... | 242/527 |
| 6,273,356 | B1 * | 8/2001 | Burton | ..... | 242/527.3 |

* cited by examiner

*Primary Examiner* — Sang Kim
(74) *Attorney, Agent, or Firm* — MKG, LLC

(57) ABSTRACT

A winder assembly is provided and includes two or more cores mounted for rotation on a turret assembly and a web of sheet-type work material is wound around a core. A lay-on roll assembly roller and a core cooperate to define a first nip. A transfer roll assembly includes a roller coupled for rotation to a rail such that the roller and a core cooperate to define a second nip. A cutting means for cutting the work material includes a traverse assembly having a work material guide means. During operation, after cutting work material, the turret assembly indexes a core into a winding position and the work material guide means is moved to the operating position such that the roller coupled to the rail causes the work material to be fed into the second nip and begin winding around the core.

14 Claims, 7 Drawing Sheets

WINDER ASSEMBLY AND METHOD OF USE THEREOF

FIELD OF THE INVENTION

The present invention is generally directed to apparatus and methods for changing cores upon which a web of sheet-type work material is wound and is more particularly directed to apparatus and methods for automatically changing a core and causing the web of sheet-type work material to be wound there around.

BACKGROUND OF THE INVENTION

Subsequent to formation, polymeric films and or sheets of polymeric material are often wound onto elongated cylindrical cores to form a roll of material. These rolls of material are usually quite large and can weigh hundreds or thousands of pounds. Because the formation of these materials generally involves a continuous process, a full roll of material is usually switched out for an empty core while the process is still running or has been momentarily stopped. This requires that the material being fed to the full roll be cut and then quickly wound onto an empty core for continued winding of the material. The cores can be coated or partially coated with an adhesive to facilitate attaching the material to the core to begin the winding process. When winding is to begin on a fresh core, it can involve an operator manually positioning the material onto the core. Since the systems for feeding the material to the core for winding generally involve other rollers and the formation of nip points between rollers, manually placing the material on the core can be quite dangerous and has historically resulted in some operators being injured by having their hands and arms caught in the above-described nip points.

SUMMARY OF THE INVENTION

The present invention resides in one aspect in a winder assembly that includes a turret assembly with a first and a second core mounted for rotation on the turret assembly. Additional cores also may be mounted on the turret assembly. Each core may be rotated into a winding position by operating the turret assembly to index the selected core into the winding position. The winder assembly includes at least one roller, referred to herein as an incoming work guide roller, coupled for rotation to a frame near to, or forming part of, the turret assembly. During operation, a web of sheet-type work material is wound around at least one of the cores. The winding assembly also includes a lay-on roll assembly which has at least one roller, referred to herein as a lay-on roller, coupled for rotation to it. The lay-on roll assembly is movable between a retracted and an engaged position wherein the lay-on roller and either one of the cores or the work material wound onto the core cooperate to define a first nip there between.

The winding assembly further includes a transfer roll assembly mounted to the frame. The transfer roll assembly has a rail slideably mounted to a frame such that the rail is moveable between a retracted and an operating position. The transfer roll assembly also includes at least one roller, referred to herein as a pivot transfer roller, coupled for rotation to the rail such that the pivot transfer roller is movable between a retracted and an engaged position. When in the engaged position, the pivot transfer roller and either one of the cores or the work material wound onto a core cooperate to define a second nip there between.

A cutting means or cutting assembly forms part of the winding assembly and it provides for cutting the work material to separate the work material from the core upon which it is being wound. The cutting assembly is coupled to the lay-on roll assembly and is movable between a retracted and an operating position. Typically, a desired amount of work material has been wound onto the first core; at this stage the first core is a full core. Thereafter, it is desired that the work material be wound upon the second core; at this stage the second core is an empty core.

The cutting means includes a traverse assembly having a cutter or a transfer knife that forms a work material edge. The traverse assembly includes a work material guide means, for example a pusher, that is movable between a retracted and an operating position. In the operating position, the guide means pushes, passes, or feeds the work material edge onto the empty core. During operation as further described herein below, the cutting means forms the work material edge, the turret assembly indexes the empty into the winding position, and the pusher is moved to the operating position. The pivot transfer roller operates to cause the work material to be fed into the second nip and begin winding around the empty core.

When the work material is being wound upon a core: (i) the lay-on roll assembly is in the engaged position; (ii) the transfer roll assembly, including the rail and the pivot transfer roller, is in the retracted position; (iii) the cutting assembly is in the retracted position; and (iv) the pusher is in the retracted position. The work material passes into the winder assembly over the incoming work guide roller, under the pivot transfer roller, under the lay-on roller between the first nip, and is wound around one of the cores. After the desired amount of material has been wound onto the full core, the lay-on roll assembly is moved into the retracted position and the turret assembly indexes 180 degrees bringing the empty core into the winding position. The transfer roll assembly, including the rail and the pivot transfer roller, is moved into the operating position. At this stage, the work material passes into the winder assembly over the incoming work guide roller, under and around the pivot transfer roller between the second nip, under and around the empty core and continues to be wound onto the full core.

Subsequently, the lay-on assembly is moved back into the engaged position and the cutting assembly is moved into the operating position. At this stage, the work material passes into the winder assembly over the incoming work guide roller, under and around the pivot transfer roller between the second nip, under the lay-on roller between the first nip, and is wound onto the full core. The traverse assembly, including the cutter, is moved across the work material forming the work material edge. The pusher is moved into the operating position such that the work material edge is guided by the pusher into the second nip. At this stage, the work material passes into the winder assembly over the incoming work guide roller, under and around the pivot transfer roller between the second nip, and is wound onto the empty core and under the lay-on roller between the first nip. Thereafter, the transfer roll assembly, the cutting assembly, and the pusher are moved to the retracted position, the lay-on roll assembly remains in the engaged position, and the work material is wound upon a core as first described hereinabove.

The present invention also resides in a method for automatically changing a core in a winder assembly. During operation, and as described above, the web of sheet-type work material is moved in the longitudinal direction and winds onto the first core, the web of sheet-type work material is cut forming a work material edge, and the work material edge is moved in the longitudinal direction and winds onto a second core. A traverse assembly includes a work material guide means or a pusher that is movable between a retracted and an operating position. When the pusher and the transfer roll assembly are in the operating position, the work material edge is guided by the pusher into the nip created by the transfer roll assembly roller and either one of the cores or the work material wound onto the core.

DETAILED DESCRIPTION OF THE PREFERRED EMBODIMENTS

Figure 1:
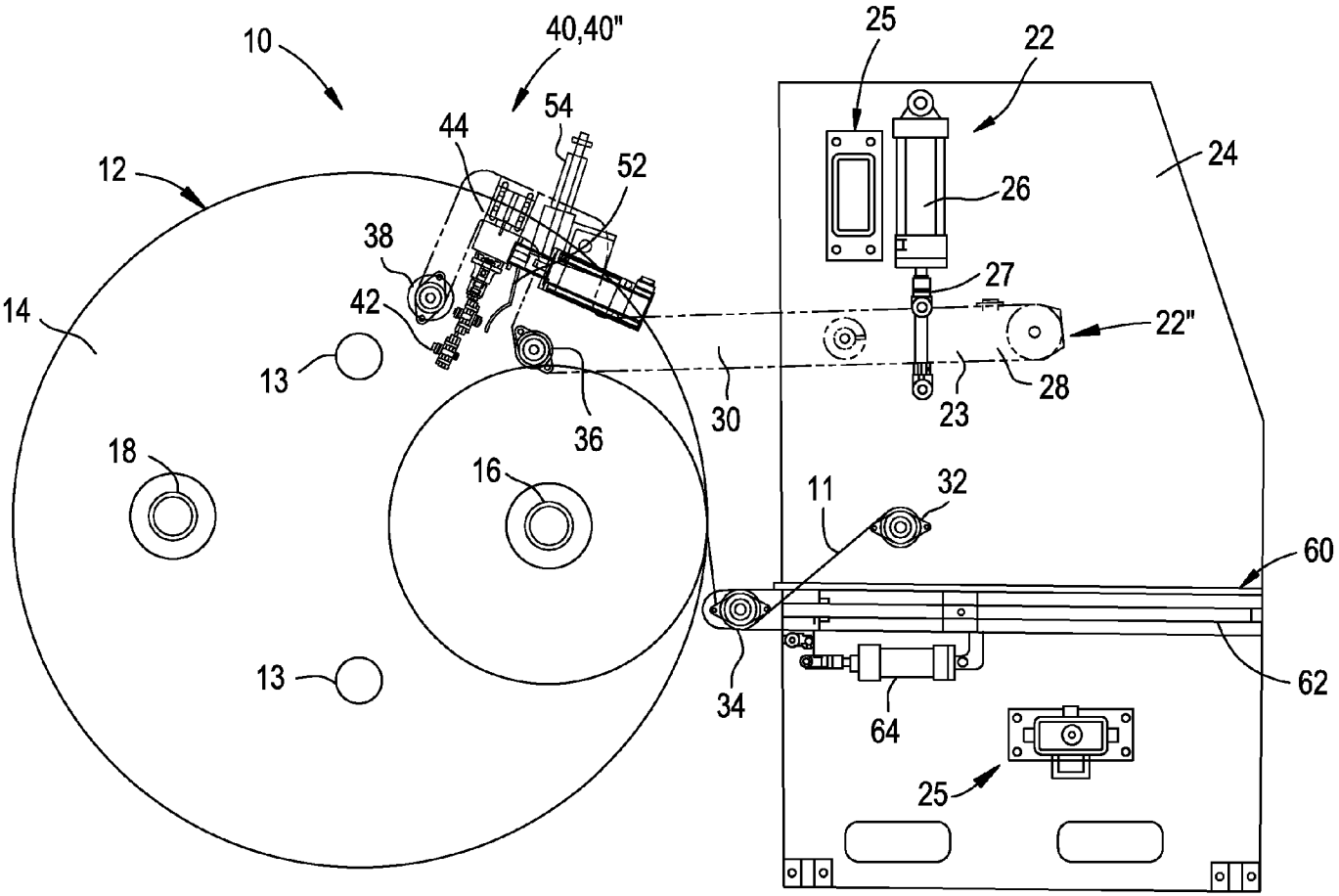
FIG. 1 schematically illustrates a winder assembly in accordance with the present invention wherein the lay-on roll assembly is in the engaged position and the cutting assembly, the transfer roll assembly, and the traverse assembly are in the retracted position.

As shown in FIGS. 1-5, a winder assembly generally designated by the reference number 10 is employed to facilitate the winding of a web of sheet-type work material 11 onto a core to form a roll of the work material. The winder assembly 10 includes a turret assembly generally designated by the reference number 12. The turret assembly 12 includes a first frame 14 and a second frame 14*a* (not shown) spaced apart from the first frame and coupled thereto by one or more spacer members generally designated by the reference number 13. A first core 16 and a second core 18 extend between the first and the second frames, 14 and 14*a* respectively, and are mounted for rotation relative thereto. Preferably, spacer members 13 define a cylindrical outer periphery corresponding to the interior periphery of a core. As shown in the illustrated embodiment, the first and the second cores, 16 and 18 respectively, are substantially parallel to, and spaced apart from, one another. A gearbox (not shown) is coupled to one of the first and second frames, 14 and 14*a* respectively, and is actuated via a motor (not shown) in response to commands issued from a controller (not shown), to rotate the first and second frames, thereby indexing one of the first and second cores 16 and 18 into a winding position (explained in greater detail below), and the other of the first and second cores into a roll removal position (also explained in greater detail below).

Figure 2:
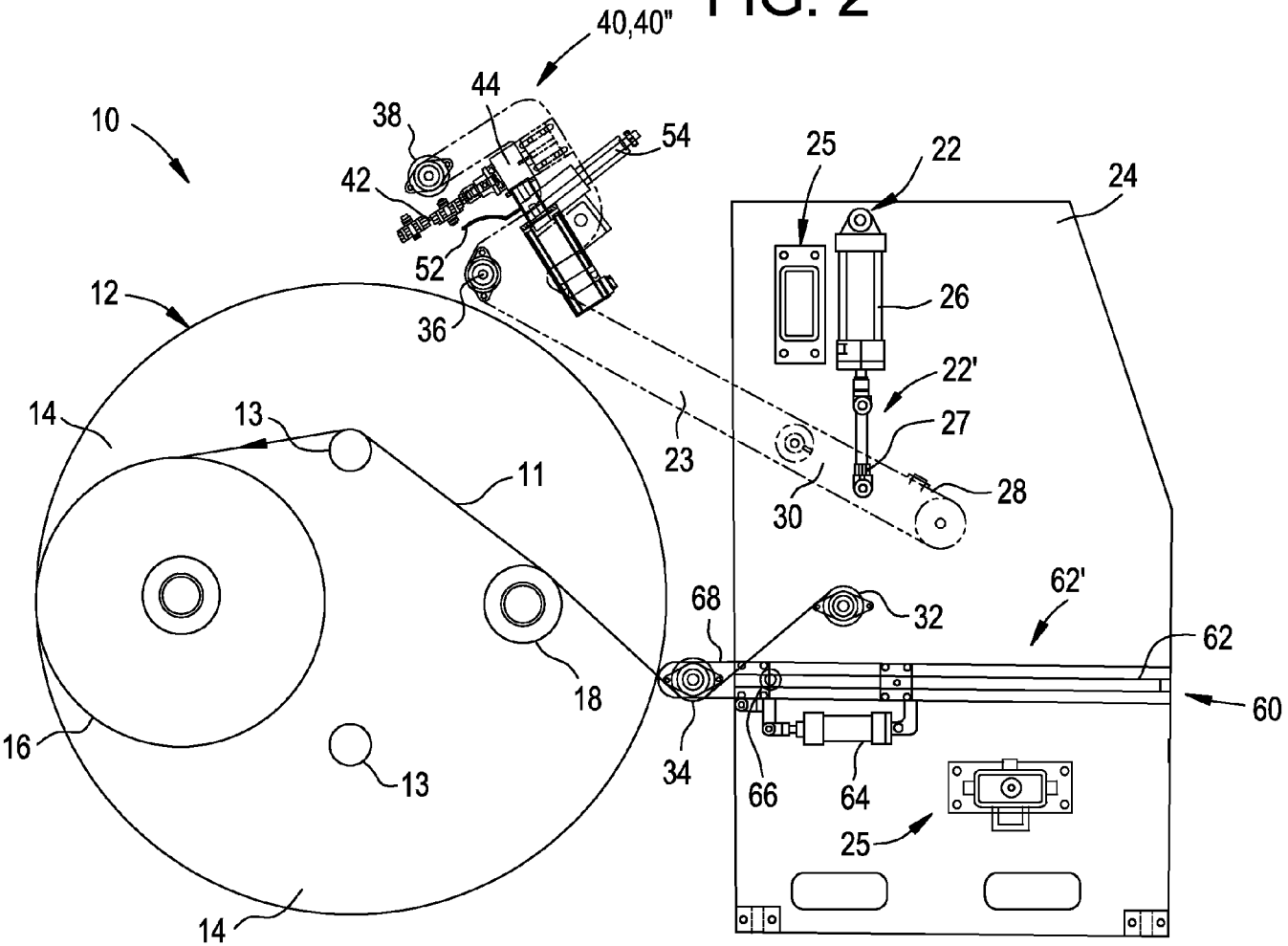
FIG. 2 schematically illustrates a winder assembly in accordance with the present invention wherein the lay-on roll assembly, the cutting assembly, the transfer roll assembly, and the traverse assembly are in the retracted position.

As shown in FIGS. 1 and 2, the winder assembly 12 also includes a lay-on roll assembly generally designated by the reference number 22. The lay on roll assembly 22 is pivotally mounted to a frame 24 for rotational movement relative thereto. The lay-on roll assembly 22 includes a pair of pivot arms 30 (only one shown) spaced apart from one another. A cutting assembly, generally designated by the reference number 40, is coupled to lay-on roll assembly 22 and may extend from a pivot arm 23 or from between the pair of pivot arms 30.

A pneumatic cylinder 26 is coupled at one end to pivot arm 23 and at another end to a frame 24. Cylinder 26 includes a plunger 27 moveable between a retracted and an extended position. An end of the plunger 27 is pivotally mounted to an end 28 of pivot arm 23 forming part of the lay-on roll assembly 22 so that movement of the piston between the retracted and the extended position causes the lay-on roll assembly to move between a retracted position 22' and an engaged position 22"; and correspondingly causes the cutting assembly to move from a retracted position 40' to an operating position 40". While a pneumatic cylinder has been shown and described, the present invention is not limited in this regard as other types of actuators such as, but not limited to, hydraulic cylinders, stepper motors, and lead screws may be substituted without departing from the broader aspects of the present invention.

Figure 6:
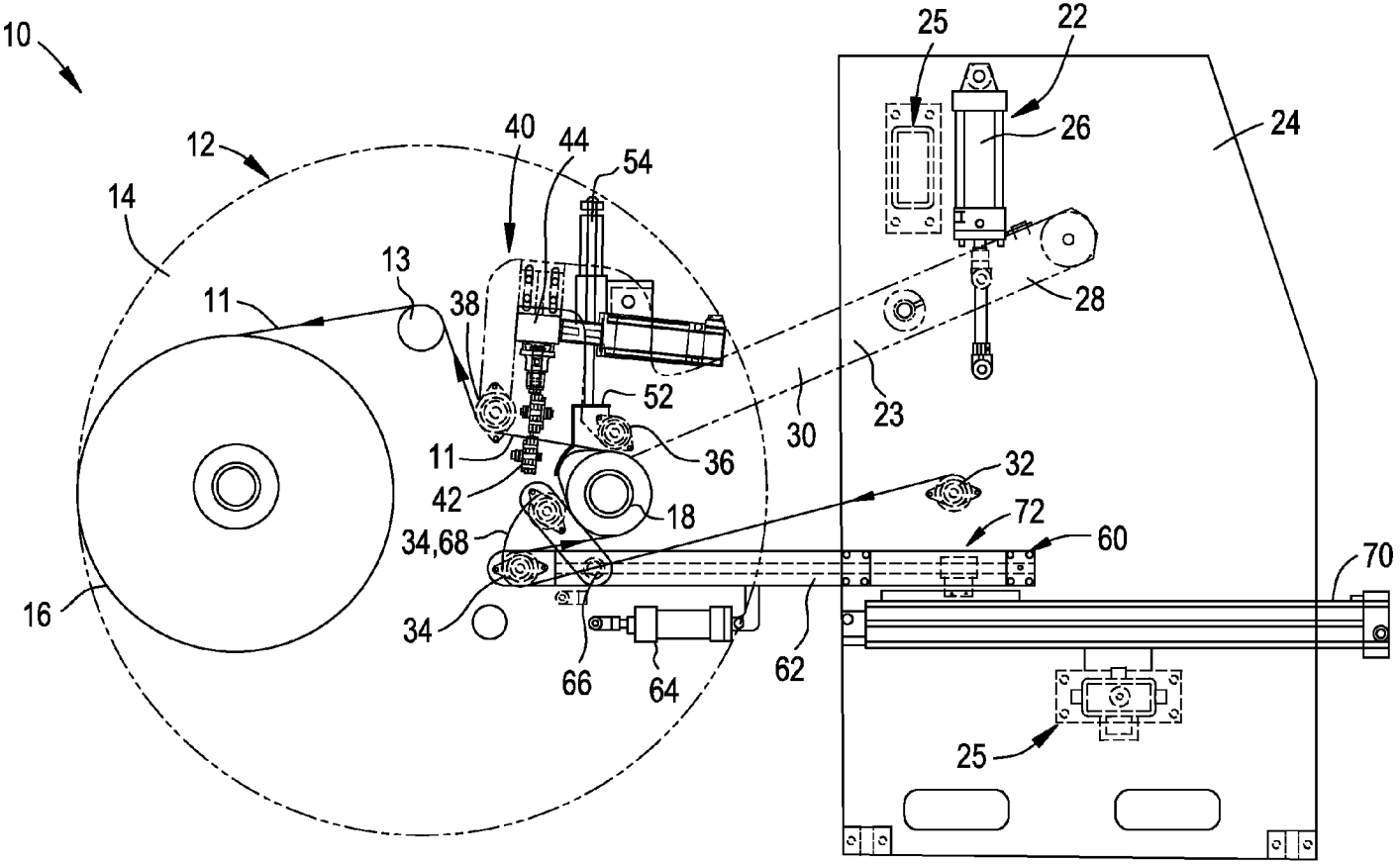
FIG. 6 schematically illustrates the winder assembly of FIG. 4 in a position immediately after the cutting of the work material.
Figure 7:
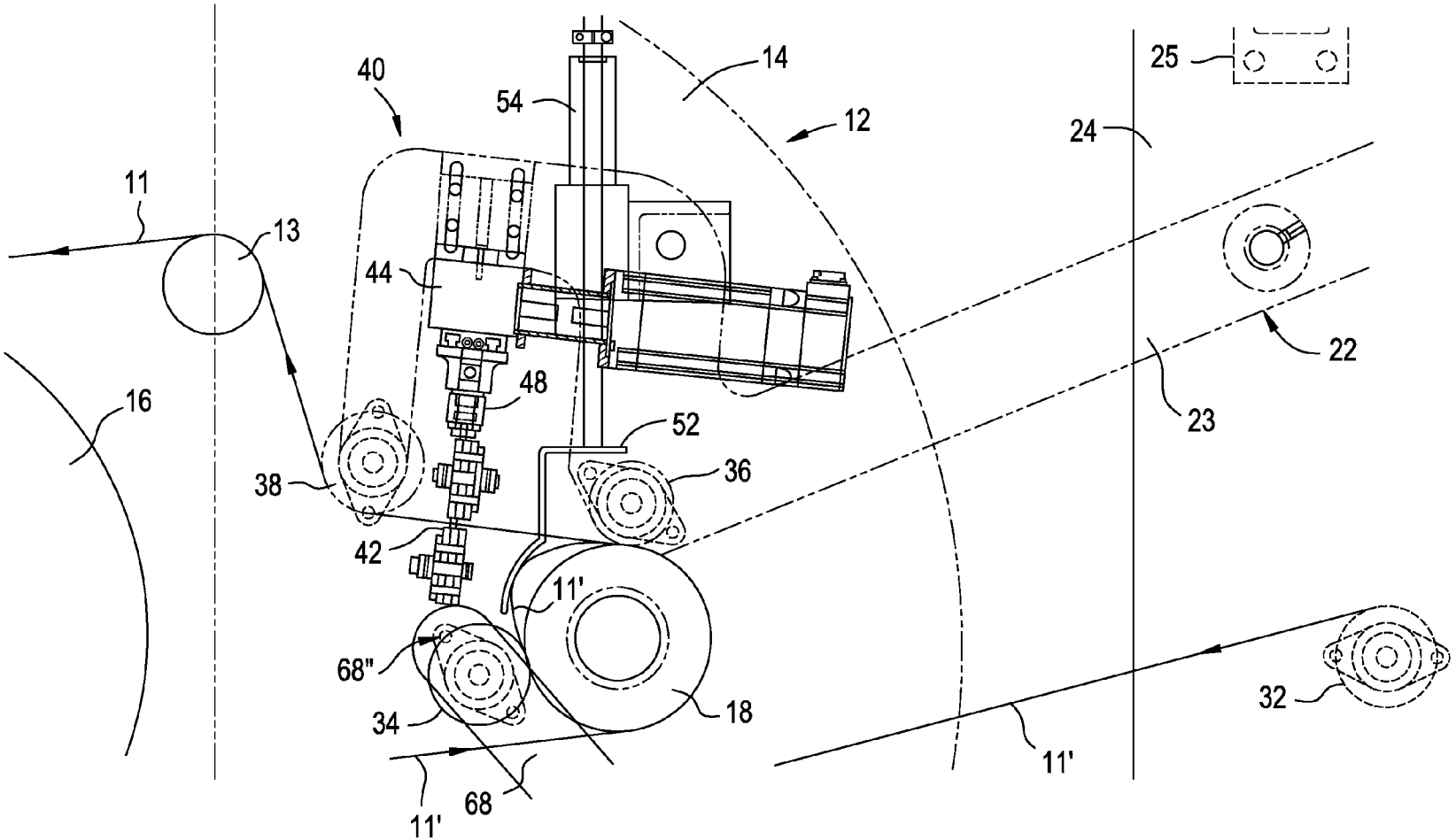
FIG. 7 further schematically illustrates the winder assembly of FIG. 6.

A transfer roll assembly, generally designated by the reference number 60, includes rail 62 which is slideably mounted to frame 24. Preferably, transfer roll assembly 60 also includes rail 62*a* (not shown) which is spaced apart from the rail 62 and which is correspondingly slideably mounted to a frame 24*a* (not shown). Frames 24 may be coupled to Frame 24*a* via one or more tie bar assemblies 25. Transfer roll assembly 60 includes a cylinder actuation means or a third actuator mounted on frame 24 for slideably extending and retracting rail 62. Rail 62 is shown in a retracted position 62' in FIG. 2 and in an operating position 62" in FIG. 3. As shown in FIG. 6, the cylinder actuation means or a third actuator is a rodless air cylinder 70 that, when actuated, moves rail 62 between retracted position 62' and operating position 62". Cylinder 70 is in slideable communication with rail 62 via a tie bar 72. While a rodless air cylinder has been shown and described, the present invention is not limited in this regard as other types of actuators such as, but not limited to, hydraulic cylinders, stepper motors, and lead screws may be substituted without departing from the broader aspects of the present invention.

Winder assembly 10 further includes four rollers: incoming work guide roller 32; pivot transfer roller 34; lay-on roller 36; and cutter assembly guide roller 38. Each of the four rollers may be covered with a polymeric or elastomeric material. Incoming work guide roller 32 is rotatably mounted to frame 24 and 24*a* (not shown). Pivot transfer roller 34 is pivotally mounted to rail 62 and 62*a* (not shown) respectively at a rail end 68 and a rail end 68*a* (not shown). Lay-on roller 36 is rotatably mounted to pivot arms 30. Cutter assembly guide roller 38 is rotatably mounted to cutting assembly 40. When lay-on assembly 22 is in engaged position 22", lay-on roller 36 and one of the cores and/or the sheet-type work material wound onto the core cooperate to define a first nip there between.

Figure 3:
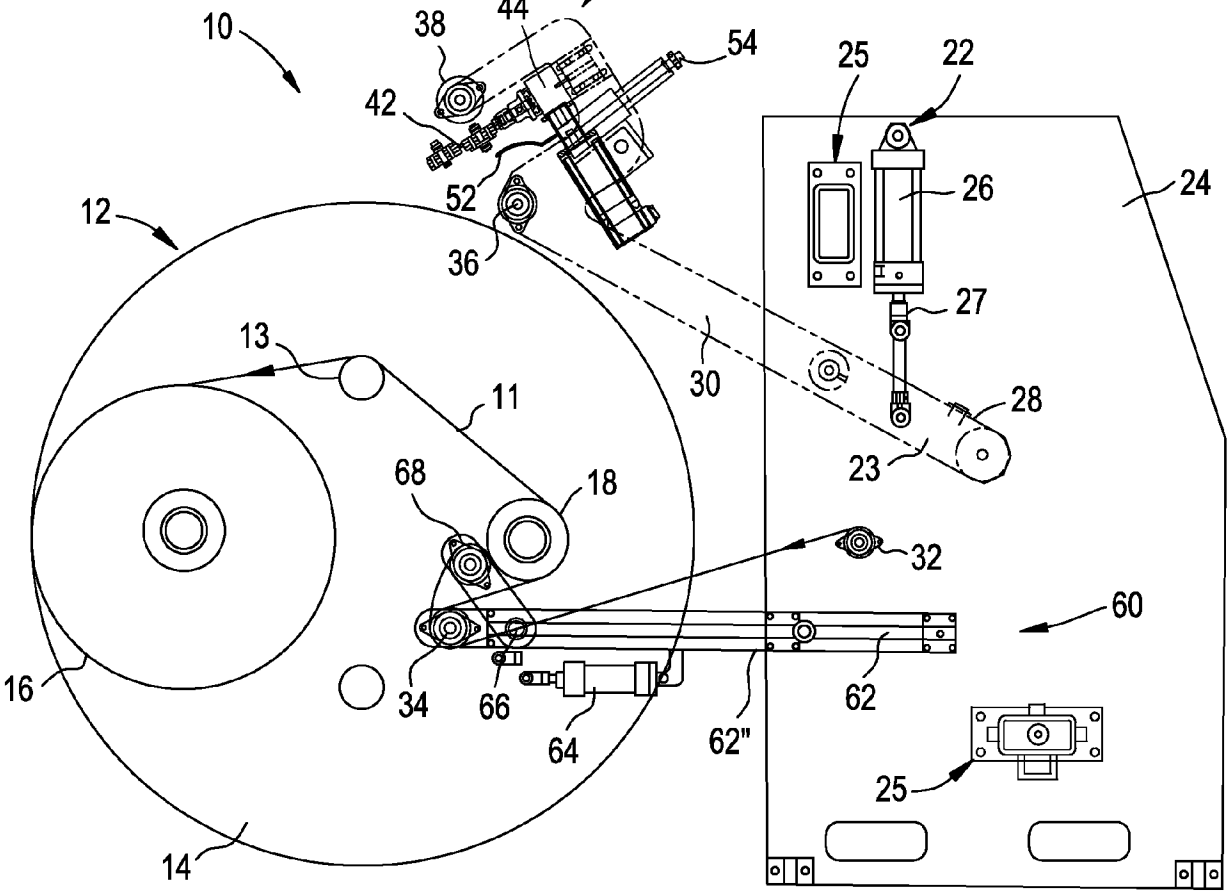
FIG. 3 schematically illustrates a winder assembly in accordance with the present invention wherein the lay-on roll assembly, the cutting assembly, and the traverse assembly are in the retracted position, and the transfer roll assembly is in the operating position.
Figure 4:
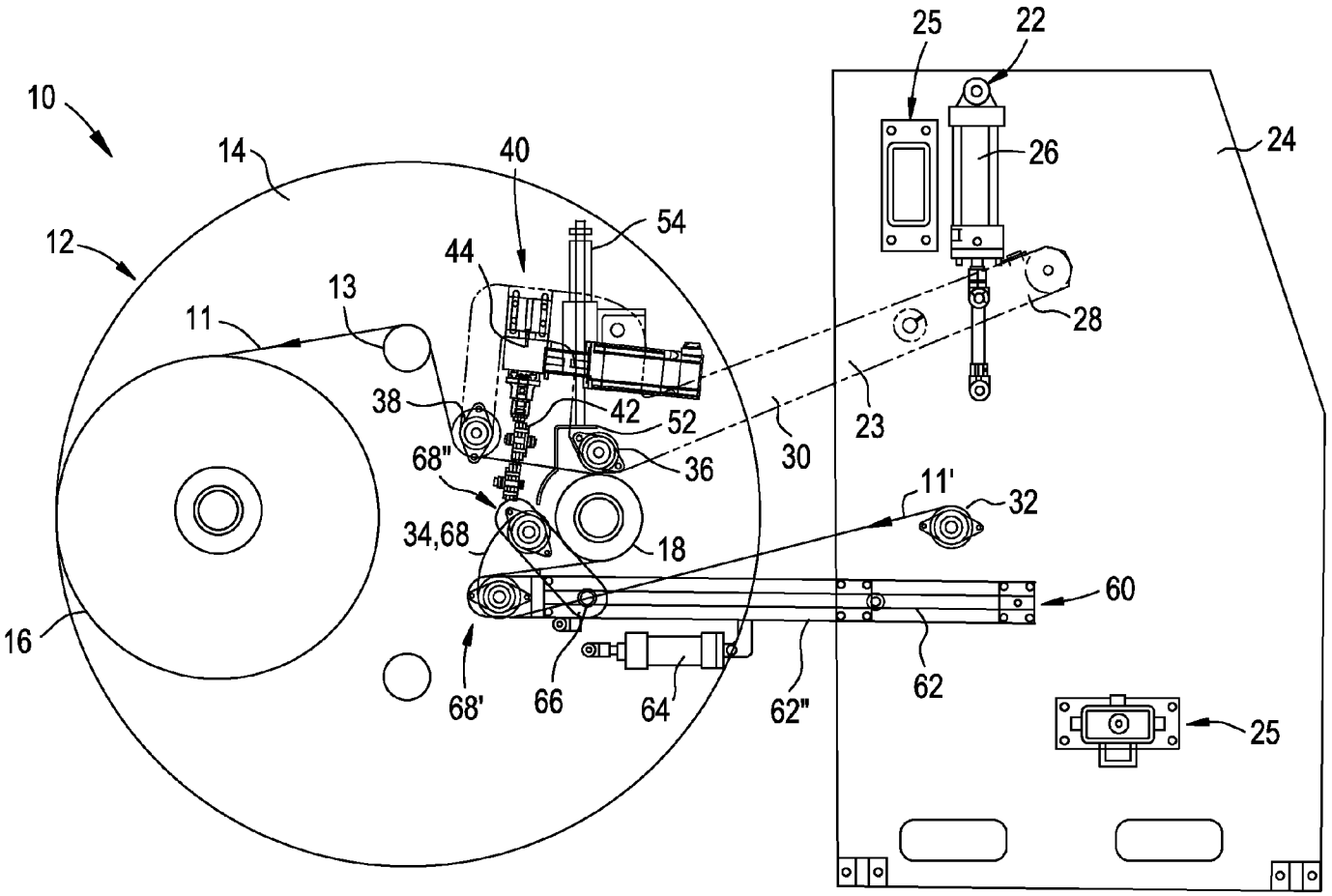
FIG. 4 schematically illustrates a winder assembly in accordance with the present invention wherein the lay-on roll assembly, the cutting assembly, the traverse assembly and the transfer roll assembly are in the operating position immediately prior to the cutting of the work material.

Transfer roll assembly 60 further includes a pneumatic cylinder 64 coupled on one end to rail end 68 and on the other end to rail 62. Cylinder 64 actuates rail end 68 of rail 62 thereby rotating rail end 68 about a pivot joint 66; rail end 68 pivotally extending from rail 62. As shown in FIG. 3 and FIG. 4, rail end 68 may be in a retracted position 68' or in an operating position 68". When rail end 68 is in operating position 68", pivot transfer roller 34 is correspondingly moved to operating position 68" so that pivot transfer roller 34 is in rolling engagement with core 18, thereby defining a second nip between pivot transfer roller 34 and core 18. While a pneumatic cylinder has been shown and described, the present invention is not limited in this regard as other types of actuators such as, but not limited to, hydraulic cylinders, stepper motors, and lead screws may be substituted without departing from the broader aspects of the present invention.

Figure 5:
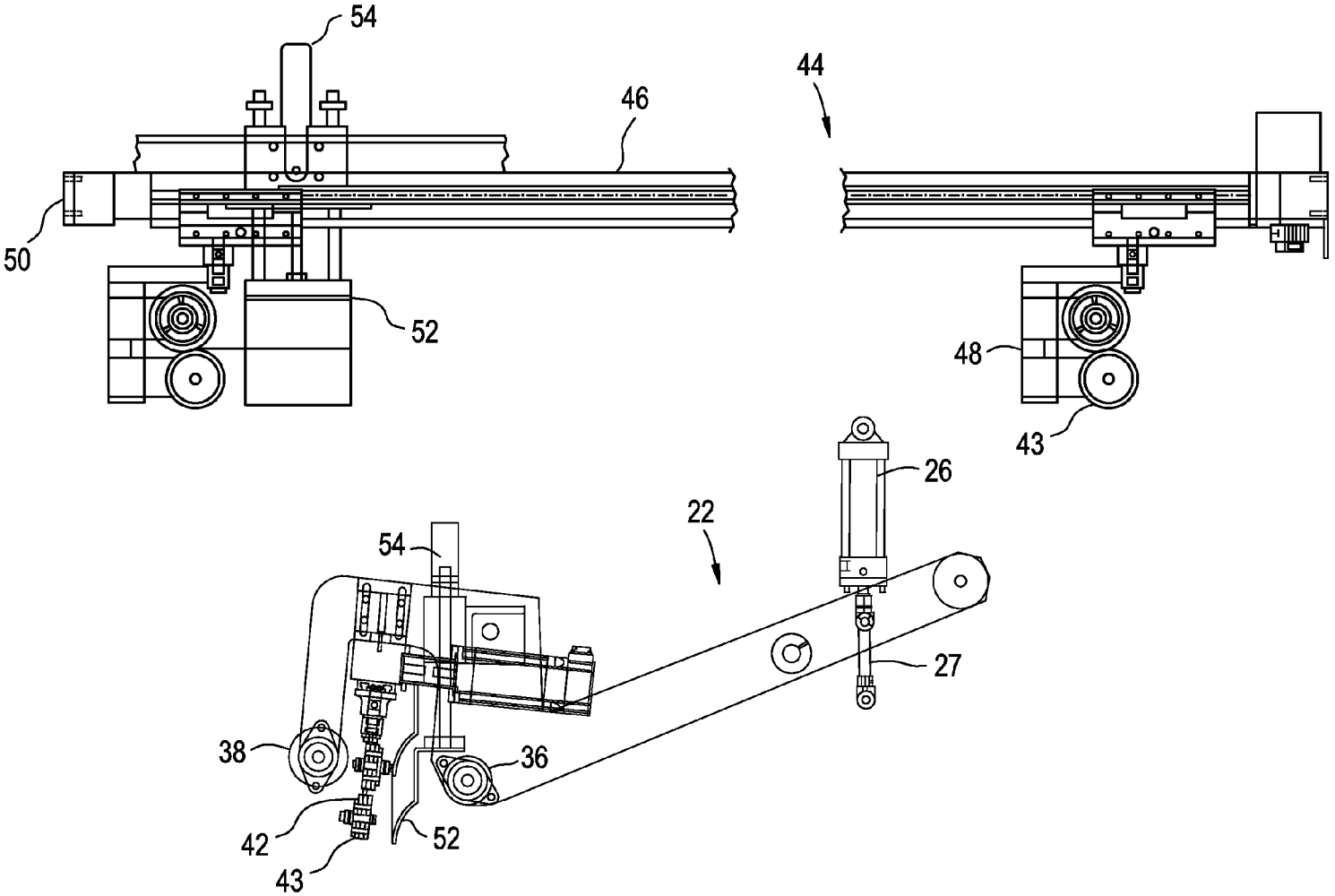
FIG. 5 schematically illustrates the cutting assembly and the traverse assembly that form part of the winder assembly of FIGS. 1-4.

Referring to FIG. 5, a cutting means or cutting assembly 40 is coupled to lay-on roll assembly 22 and may extend from pivot arm 23 or from between the pair of pivot arms 30. The cutting assembly 40 includes a cutter 42, also referred to herein as a transfer knife, that can be in the form of a cutting blade or a cutting wheel 43. The cutter 42 is movable transversely across the web of sheet-type work material 11 to cut and separate the work material from the core about which the work material is being wound once a desired amount of work material has been wound onto the core. Once the cutter 42 cuts the work material, a tail of work material having a work material edge hangs below cutting assembly 40.

Cutting assembly 40 includes a traverse assembly generally designated by the reference number 44. Traverse assembly 44 includes a track 46 that extends transversely across the work material 11. A cutting head 48 having the cutter 42 mounted thereon is coupled to the track 46 for rectilinear movement there along. An actuation means 50 is coupled to the cutting head 48 and the track 46 and is operable to cause the cutting head to move along the track. Preferably, actuation means 50 comprises a pneumatic cylinder; however, the present invention is not limited in this regard as other types of actuators such as, but not limited to, hydraulic cylinders, stepper motors, and lead screws may be substituted without departing from the broader aspects of the present invention.

Traverse assembly 44 also includes a work material guide means, referred to herein as a pusher 52, for guiding the work material onto a core as further described herein and below. The traverse assembly includes a fourth actuator referred to herein as pneumatic cylinder 54 for actuating pusher 52 as further described below. Cylinder 54 may be in a retracted position thereby retaining pusher 52 in a retracted position as shown in FIG. 3; or cylinder 54 may be in an extended position thereby placing pusher 52 in an operating position as shown in FIG. 4. Pusher 52 may extend the length of lay-on roller 36 and correspondingly extend transversely across work material 11. Alternatively, pusher 52 may extend a portion of the length of lay-on roller 36 and be slideably mounted upon track 46 such that pusher 52 may traverse work material 11. While a pneumatic cylinder has been shown and described, the present invention is not limited in this regard as other types of actuators such as, but not limited to, hydraulic cylinders, stepper motors, and lead screws may be substituted without departing from the broader aspects of the present invention.

During operation as shown in FIG. 1, work material 11 extends between the rollers in woven fashion such that the work material passes over incoming work guide roller 32, under pivot transfer roller 34, and under lay-on roller 36. Therefore, when the lay-on roll assembly 22 is in the engaged position 22", lay-on roller 36 is in rolling engagement with the work material 11 being wound onto the core. The work material is fed between the first nip defined by the lay-on roller 36 and the work material already wound onto the core. While the lay-on roll assembly 22 has been shown and described as being pivotally mounted to the frame 24, the present invention is not limited in this regard as the lay-on roll assembly can be mounted to other items or the lay-on roll assembly can be mounted onto its own stand without departing from the broader aspects of the present invention.

Referring to FIGS. 1 and 2, during operation, work material 11 extends between, moves relative to, and is engaged by, the rollers. The work material 11 passes over incoming work guide roller 32, under pivot transfer roller 34, under lay-on roller 36 and is wound around one of the first and second cores, core 16 as depicted, to form a roll of work material. The work material 11, prior to reaching the core, is created or processed upstream of the winder assembly 10. While the work material 11 is being wound onto core 16, the lay-on roll assembly 22 is in engaged position 22" wherein lay-on roller 36 rollingly engages the work material being wound onto core 16, forming the first nip there between.

Once a desired amount of work material 11 has been wound onto a core, the lay-on roll assembly 22 moves from the engaged position 22" to the retracted position 22'. The turret assembly 12 rotatingly indexes an empty core into the winding position for winding the work material 11 thereon. Since the work material 11 is still winding onto the full core 16, work material 11 now passes over empty core 18 and over turret spacer member 13 prior to winding onto the full core 16. As shown in FIG. 3, rail 62 of transfer roll assembly 60 moves from the retracted position 62' to the operating position 62", and rotating rail end 68 moves from retracted position 68' to operating position 68" defining the second nip between pivot transfer roller 34 and core 18 and thereby wrapping work material 11 around core 18. Rotating rail end 68 may remain in operating position 68" such that pivot transfer roller 34 rolling engages the core onto which work material 11 is being wound. Lay-on roll assembly 22 returns to the engaged position 22" from the retracted position 22' wherein lay-on roller 36 and core 18 and/or the sheet-type work material wound onto the core cooperate to define the first nip there between. Correspondingly, cutting assembly 40 returns to the operating position 40" from the retracted position 40'.

Referring to FIGS. 4-7, actuator 50 sets cutting head 48 in motion thereby causing the cutter or transfer knife 42 to move transversely across the work material 11 whereby a web of sheet-type work material 11' is cut from the core 16 upon which it was being wound. Once the work material 11' has been cut, a work material edge is defined. The work material 11' extends between the first nip created by lay-on roller 36 being in rolling engagement with the work material 11' being wound onto the core 18.

Cylinder 54 actuates pusher 52 thereby placing pusher 52 in an operating position such that the work material edge of work material 11' is guided into the second nip created by pivot transfer roller 34 being in rolling engagement with core 18 and/or the work material 11' being wound onto core 18. After initiating the winding of work material 11' onto core 18, cylinder 54 actuates pusher 52 thereby returning pusher 52 to a retracted position. Optionally, third actuator 63 may return rail 62 of transfer roll assembly 60 to the retracted position 62' from the operating position 62"; and cylinder 64 may return rotating rail end 68 to the retracted position 68' from the operating position 68". While the work material guide means has been shown and described as a pusher, the present invention is not limited in this regard as other types of guide means such as, but not limited to, a roller, a shaft or other type of pole, and a bar or other type of rod may be substituted without departing from the broader aspects of the present invention.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A winder assembly comprising:

a turret assembly including a first core and at least a second core mounted for rotation on the turret assembly so that during operation a web of sheet-type work material can be wound around the first and second cores, the turret assembly being operable to index the first and second cores into a winding position;

a lay-on roll assembly including at least one roller coupled for rotation to the lay-on roll assembly, the lay-on roll assembly being movable between a retracted and an engaged position wherein the at least one roller and one of the core and the sheet-type work material wound onto the core cooperate to define a first nip there between;

a transfer roll assembly including:

a rail slideably mounted to a frame, the rail being moveable between a retracted and an operating position;

at least one roller coupled for rotation to the rail, the roller being movable between a retracted and an engaged position wherein the roller and one of the core and the sheet-type work material wound onto the core cooperate to define a second nip there between;

a cutting means for cutting the web of sheet-type work material to separate the work material from one of the first and second cores in response to the core having a desired amount of work material rolled there around and thereby forming a work material edge; the cutting means including:

a traverse assembly including a work material guide means being moveable between a retracted and an operating position, and wherein during operation, after the cutting means forms the work material edge, the turret assembly indexes the other of the first and second cores into the winding position and the work material guide means is moved to the operating position whereby the roller coupled for rotation to the rail is operable to cause the sheet-type work material to be fed into the second nip and begin winding around the core.

2. A winder assembly as defined by claim 1, the lay-on roll assembly further including at least one pivot arm coupled to a first actuator, the first actuator being moveable between a retracted and an extended position thereby moving the lay-on roll assembly between the retracted and the engaged position.

3. A winder assembly as defined by claim 2, the first actuator comprising a pneumatic cylinder, the first actuator being coupled to the frame.

4. A winder assembly as defined by claim 1, the transfer roll assembly further including a second actuator, the second actuator being moveable between a retracted and an extended position thereby moving the rail between the retracted and the operating position.

5. A winder assembly as defined by claim 4, the second actuator comprising a pneumatic cylinder, the second actuator being coupled to the frame.

6. A winder assembly as defined by claim 1, the transfer roll assembly rail having a rail end pivotally extending there from and being moveable between a retracted and an operating position, the at least one roller being coupled for rotation to the rail end, the roller being movable between a retracted and an engaged position wherein the roller and one of the core and the work material wound onto the core cooperate to define the second nip there between.

7. A winder assembly as defined by claim 6, the transfer roll assembly further including a third actuator, the third actuator being moveable between a retracted and an extended position thereby moving the rail end between the retracted and the operating position.

8. A winder assembly as defined by claim 7, the third actuator comprising a pneumatic cylinder, the third actuator being coupled on one end to the rail end and on the other end to the rail.

9. A winder assembly as defined by claim 1, the traverse assembly work material guide means defining a pusher, the pusher moveable between a retracted and an operating position.

10. A winder assembly as defined by claim 9, the traverse assembly further including a fourth actuator, the fourth actuator being moveable between a retracted and an extended position thereby moving the pusher between the retracted and the operating position.

11. A winder assembly as defined by claim 10, the fourth actuator comprising a pneumatic cylinder, the fourth actuator being coupled on one end to the cutting assembly and on the other end to the pusher.

12. A method for changing cores on a winder assembly, comprising:

providing a turret assembly including a first core and at least a second core mounted for rotation on the turret assembly, the first core having a web of sheet-type work material winding there around;

providing a lay-on roll assembly moveable between a retracted and an engaged position, the lay-on roll assembly having at least one roller forming part thereof, the lay-on roll assembly being in the engaged position with the roller rotatably engaged with the work material winding onto the first core forming a first nip between the roller and the first core;

causing a first actuator, in response to commands issued from a controller, to operate to move the lay-on roll assembly to the retracted position wherein the roller is tilted off of and away from the work material wound onto the first core;

causing the turret assembly, in response to commands issued from the controller, to index the first core onto a roll removal position and the second core into a winding position;

causing the first actuator, in response to commands issued from a controller, to operate to move the lay-on roll assembly to the engaged position with the roller rotatably engaged with the work material winding onto the first core;

cutting the work material to separate the work material from the roll of work material wound onto the first core, thereby creating a work material edge;

providing a transfer roll assembly moveable between a retracted and an operating position, the transfer roll assembly having at least one roller forming part thereof; and actuating a second actuator, in response to commands issued from the controller, thereby causing the transfer roll assembly to move from the retracted to the operating position so that the roller forming part of the transfer roll assembly rotatably engages the second core forming a second nip between the roller and the second core;

providing a transfer roll assembly rail having a rail end pivotally extending there from and being moveable between a retracted and an operating position, the at least one roller being coupled for rotation to the rail end, the roller being movable between a retracted and an engaged position; and actuating a third actuator, in response to commands issued from the controller, thereby causing the rail end and the roller to move from the retracted to the operating position so that the roller forming part of the transfer roll assembly rotatably engages the second core forming a second nip between the roller and the second core.

13. A method for changing cores on a winder assembly as defined by claim 12 further providing a work material guide means being moveable between a retracted and an operating position and actuating, via commands issued from the controller, a fourth actuator thereby causing the work material guide means to move from the retracted to the operating position which in turn causes the work material guide means to engage the work material and feed the work material edge into the second nip.

14. A method for changing cores on a winder assembly as defined by claim 13 wherein the work material guide means defines a pusher and actuating the fourth actuator moves the pusher from a retracted position to an operating position which in turn causes the pusher to engage the work material and feed the work material edge into the second nip.

* * * * *